US011465724B1

(12) United States Patent
Jackson et al.

(10) Patent No.: US 11,465,724 B1
(45) Date of Patent: Oct. 11, 2022

(54) TROLLING MOTOR WITH MULTI-CONDUCTOR CORD

(71) Applicants: Derek Anthony Jackson, Mankato, MN (US); Shannon Ty Sivertsen, Mankato, MN (US)

(72) Inventors: Derek Anthony Jackson, Mankato, MN (US); Shannon Ty Sivertsen, Mankato, MN (US)

(73) Assignee: Johnson Outdoors Inc., Racine, WI (US)

( * ) Notice: Subject to any disclaimer, the term of this patent is extended or adjusted under 35 U.S.C. 154(b) by 23 days.

(21) Appl. No.: 17/076,561

(22) Filed: Oct. 21, 2020

Related U.S. Application Data

(60) Provisional application No. 62/924,939, filed on Oct. 23, 2019.

(51) Int. Cl.
*B63H 20/00* (2006.01)
*B63H 20/12* (2006.01)
*B63H 20/10* (2006.01)

(52) U.S. Cl.
CPC ..... *B63H 20/007* (2013.01); *B63H 20/106* (2013.01); *B63H 20/12* (2013.01)

(58) Field of Classification Search
CPC ..... B63H 20/007; B63H 20/106; B63H 20/12
See application file for complete search history.

(56) References Cited

U.S. PATENT DOCUMENTS

| | | | | |
|---|---|---|---|---|
| 5,169,349 | A * | 12/1992 | Hilbert | B63H 20/007 440/6 |
| 6,254,441 | B1 | 7/2001 | Knight et al. | |
| 6,325,685 | B1 | 12/2001 | Knight et al. | |
| 6,369,542 | B1 | 4/2002 | Knight et al. | |
| 6,431,923 | B1 | 8/2002 | Knight et al. | |
| 6,447,348 | B1 | 9/2002 | Gilley | |
| 7,056,166 | B2 | 6/2006 | Bernloehr | |
| 7,134,924 | B2 | 11/2006 | Takeda et al. | |
| 7,163,427 | B1 | 1/2007 | Lee | |
| 7,614,925 | B2 | 11/2009 | Boebel et al. | |
| 8,858,280 | B1 | 10/2014 | Wiegele et al. | |
| 8,894,453 | B2 | 11/2014 | Case | |
| 8,936,498 | B1 | 1/2015 | Lee | |
| 9,260,173 | B2 | 2/2016 | Case | |
| 9,278,745 | B2 | 3/2016 | Kooi et al. | |

(Continued)

FOREIGN PATENT DOCUMENTS

WO WO 2017/0136955 A1 8/2017

*Primary Examiner* — Stephen P Avila
(74) *Attorney, Agent, or Firm* — Reinhart Boerner Van Deuren P.C.

(57) ABSTRACT

A trolling motor includes a rotatable trim module which effectuates trim adjustment of the trolling motor by adjusting a vertical position of a motor shaft assembly. A rotatable steering module is mounted below the trim module. The steering module and trim module are assembled on a rotatable motor shaft having a motor mounted at one end of the motor shaft. A conductive cord is coiled around the motor shaft. The conductive cord is configured to transmit electrical power from a power source to an internal control module and a drive motor in the trim module. In further embodiments, the conductive cord also transmits control signals from an internal control device to an internal control module in the trim module.

11 Claims, 3 Drawing Sheets

(56) References Cited

U.S. PATENT DOCUMENTS

| | | | | |
|---|---|---|---|---|
| 9,296,455 | B2 | 3/2016 | Bernloehr et al. | |
| 10,035,575 | B2 | 7/2018 | Bernloehr et al. | |
| 2007/0197107 | A1 | 8/2007 | Lee | |
| 2007/0232157 | A1 | 10/2007 | Lee | |
| 2016/0001865 | A1* | 1/2016 | Bernloehr ..... | B63H 21/17 440/7 |
| 2016/0325814 | A1 | 11/2016 | Antao et al. | |
| 2020/0290714 | A1* | 9/2020 | Ambler ..... | B63H 20/007 |

* cited by examiner

TROLLING MOTOR WITH MULTI-CONDUCTOR CORD

CROSS-REFERENCE TO RELATED PATENT APPLICATIONS

This patent application claims the benefit of U.S. Provisional Patent Application No. 62/924,939, filed Oct. 23, 2019, the entire teachings and disclosure of which are incorporated herein by reference thereto.

FIELD OF THE INVENTION

This invention generally relates to electric trolling motors for recreational watercraft.

BACKGROUND OF THE INVENTION

Trolling motors are typically used on small boats and for a number of different applications, including but not limited to fishing, recreation, and commercial applications. Trolling motors typically include provisions for placing the same into a stowed position during transportation. In the stowed position, the trolling motor is generally horizontal and parallel with a top surface of the bow. In many conventional trolling motors, manual manipulation of the device is required to place the motor in the stowed position. For example, a user could rotate the motor shaft assembly which includes a motor shaft, a motor power unit and optionally, a head unit about the base assembly of the trolling motor from a deployed position in which the motor shaft assembly was generally perpendicular to the top surface of the boat, to the aforementioned stowed position.

Fishing boats and other vessels are often equipped with trolling motors for providing a relatively small amount of thrust to slowly and quietly propel the boat or vessel. Trolling motors advantageously provide for a finer adjustment of watercraft position than a main motor/propeller combination. Typically, the trolling motor is powered electrically using a boats existing electrical power source, or a stand-alone electrical power source which in either case is most often a battery. Examples of a contemporary trolling motor may be found at U.S. Pat. No. 9,296,455 to Bernloehr et al., and at U.S. Pat. Nos. 6,325,685 and 6,369,542 to Knight et al., the entire teachings and disclosures of which are incorporated by reference herein.

In some conventional trolling motors, a slip ring assembly is positioned between steering module and the trim module. Electrical power and control signals may be transmitted from an internal control device through the slip ring assembly to the trim module to provide electrical power and/or a control signal to a control mechanism in the trim module via the slip ring assembly. Contact rings are operably connected to the control mechanism of trim module to provide electrical power thereto. In certain conventional trolling motors, the trim module drive motor receives electrical power transmitted via a slip ring assembly, and is controlled wirelessly by an internal control module, which also receives its electrical power through the slip ring assembly. However, these control signals may occasionally drop some of their data due to interruptions in the wireless data signal.

Embodiments of the invention described herein represent an improvement to the state of the art with respect to trolling motors. These and other advantages of the invention, as well as additional inventive features, will be apparent from the description of the invention provided herein.

BRIEF SUMMARY OF THE INVENTION

In embodiments of the present invention, a trolling motor for a watercraft includes a tiltable steering module which effectuates the steering capabilities of trolling motor, and a rotatable trim module which effectuates trim adjustment of the trolling motor by adjusting the vertical position of a motor shaft assembly. The rotatable motor shaft assembly has a motor shaft, with a head unit and a motor power unit mounted at opposed ends of the motor shaft.

In one aspect, embodiments of the invention provide a trolling motor with a rotatable trim module which effectuates trim adjustment of the trolling motor by adjusting a vertical position of a motor shaft assembly. A tiltable steering module is mounted below the trim module. The steering module and trim module are assembled on a rotatable motor shaft having a motor mounted at one end of the motor shaft. A conductive cord is coiled around the motor shaft. The conductive cord is configured to transmit electrical power and/or control signals from a power source and an internal control device, e.g., in the steering module or some other portion of the trolling motor, to a drive motor and an internal control module in the trim module.

In certain embodiments, the conductive cord coiled and trim module are configured such that the trim module can rotate at least 200 degrees in the clockwise or counterclockwise direction from an unrotated state, for example where the trolling motor propeller is facing sternward or in the direction directly behind the boat. However, it is envisioned that the unrotated state may be one in which the propeller faces any predetermined direction. As used herein, the term "unrotated" is to be interpreted consistently with the definition provided above.

Alternate embodiments of the invention include trim modules that can rotate more than, or less than, 200 degrees. For example, in specific embodiments, the conductive cord coiled and trim module are configured such that the trim module can rotate at least 180 degrees from the unrotated state. In certain embodiments, the conductive cord coiled and trim module are configured such that the trim module can rotate at least 360 degrees in the clockwise or counterclockwise direction from the unrotated state.

In a particular embodiment, the conductive cord is configured to transmit power and/or control signals from the internal control device, in the steering module or other part of the trolling motor, to the drive motor and the internal control module in the trim module. In some embodiments, the trim module includes a frame with guide fingers that are configured to keep the conductive cord from tangling or binding. The guide fingers may be comprised of one or more slotted openings in a frame of the trim module.

In particular embodiments of the invention, the trim module includes two sets of guide fingers spaced apart on the frame. In more specific embodiments, a first set of guide fingers has one slotted opening, and a second set of guide fingers has two slotted openings. Furthermore, the two sets of guide fingers may be located on opposite sides of a trolling motor shaft when the frame and the trim module are assembled to the trolling motor shaft.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In embodiments of the present invention described hereinbelow, a trolling motor for a watercraft includes a tiltable steering module which effectuates the steering capabilities of trolling motor, and a rotatable trim module which effectuates trim adjustment of the trolling motor by adjusting the vertical position of a motor shaft assembly. The rotatable motor shaft assembly has a motor shall, with a head unit and a motor power unit mounted at opposed ends of the motor shaft.

The aforementioned rotatable trim module operates to provide a trim adjustment feature which allows the user to vary the distance between the motor power unit including its associated propeller and the mounting location of the trolling motor. This allows a user to operate the trolling motor in shallower waters, or conversely allows a user to ensure the propeller is sufficiently spaced away from the boat hull. This trim adjustment feature in the past has been provided as a manually manipulated feature which essentially amounted to a collar through which the motor shaft assembly was slidable. A set screw or other locking feature is provided on the collar such that when loosened the motor shaft assembly is slidable relative to the collar, and when tightened, the motor shaft assembly is locked at a specific height.

Figure 1:
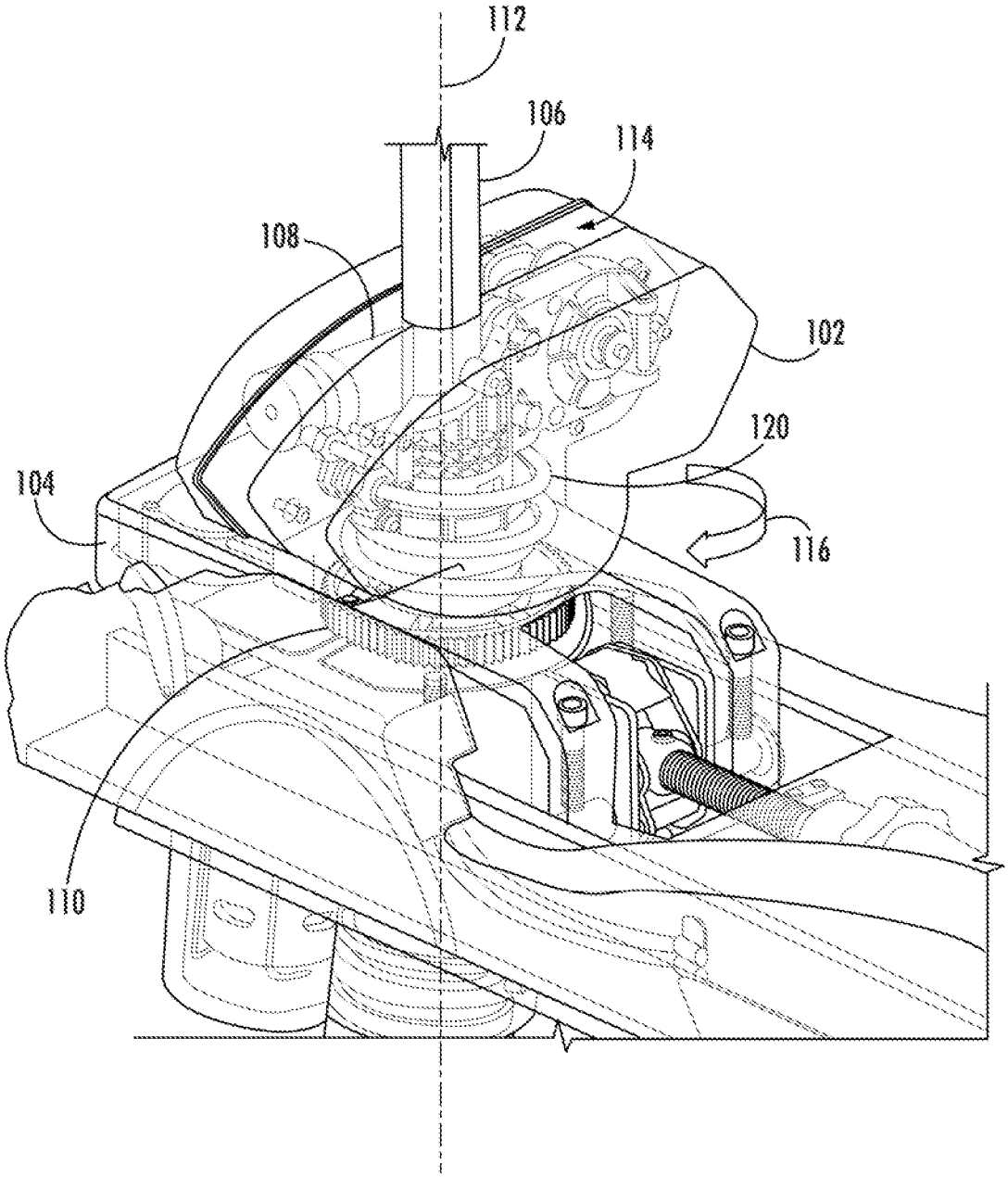
FIG. 1 is a perspective view of a trolling motor with trim and steering modules, constructed in accordance with an embodiment of the invention.
Figure 2:
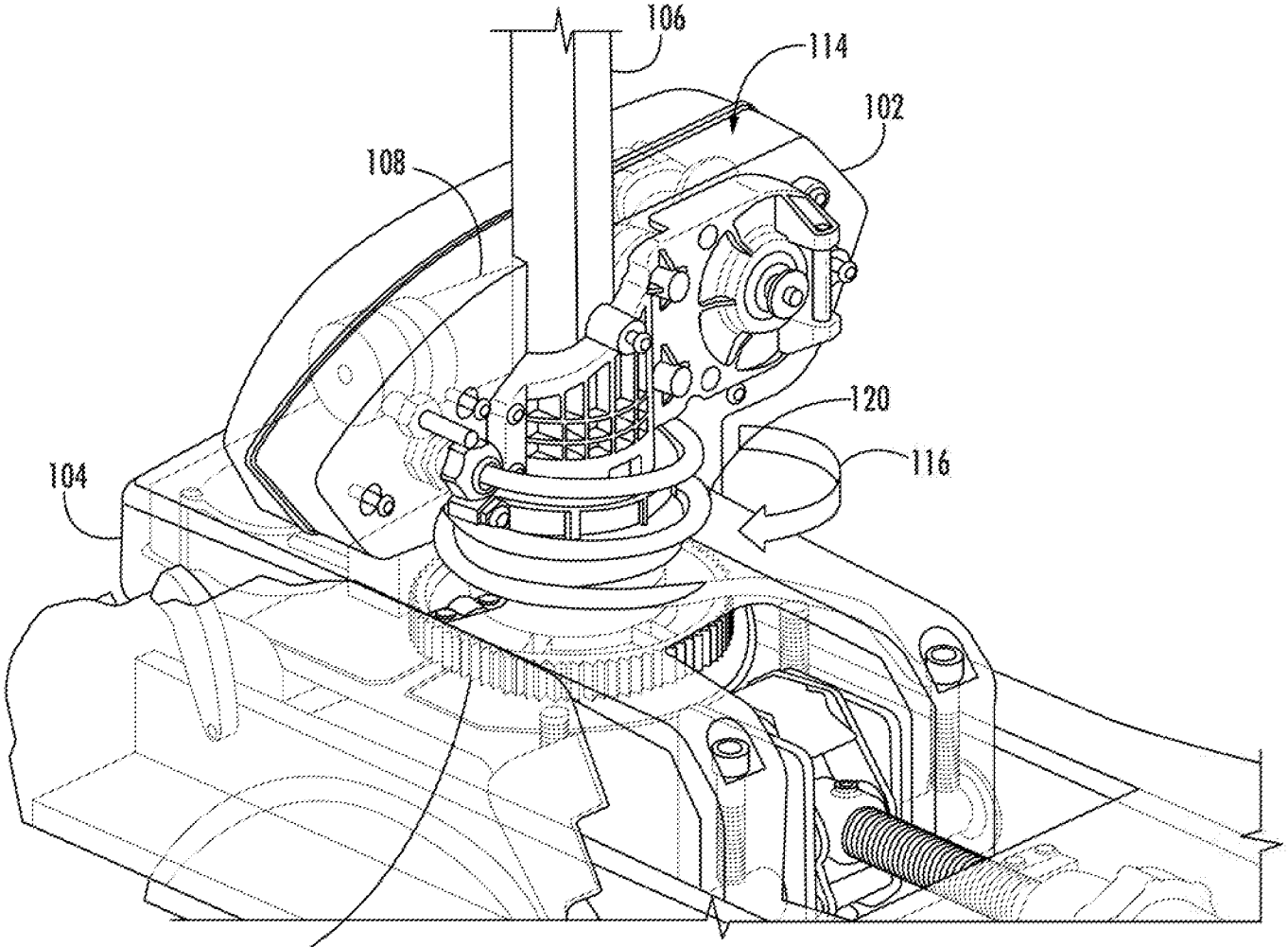
FIG. 2 is a perspective view of the trim and steering modules of FIG. 1 showing a trim module frame with guide fingers, in accordance with an embodiment of the invention.

FIG. 1 is a perspective view of a trolling motor 100 with trim and steering modules 102, 104, constructed in accordance with an embodiment of the invention. FIG. 2 is a perspective view of the trim module 102 and steering module 104 from FIG. 1, according to an embodiment of the invention.

In embodiments of the invention, the trolling motor 100 includes the trim module 102, a motor shaft 106, a head unit (not shown), and a motor power unit (not shown) which are rotatable in both clockwise and counterclockwise rotational directions about a longitudinal axis 112 to effectuate the steering of the watercraft by directing thrust provided by motor power unit. The motor shaft, head unit, and motor power unit are vertically adjustable along the longitudinal axis in first and second linear directions to provide for the aforementioned trim adjustment by changing the vertical position of motor power unit relative to base assembly.

In certain embodiments, the trim module 102 includes an internal drive arrangement for linearly moving the motor shaft 106. The internal drive arrangement may have a trim module drive motor 108 operably coupled to an input drive gear of the internal drive arrangement. Additionally, the steering module 104 may also include an internal drive arrangement that has an input drive motor, a main drive gear 110, and a drive train coupled between the input drive motor and the drive gear.

In certain embodiments, the motor mount is positioned adjacent and underneath the steering module 104. In the embodiment of FIGS. 1 and 2, the trim module 102 is mounted on top of steering module 104. The motor shaft 106 extends through each of the steering module 104 and trim module 102. Openings are also formed through the bottoms of the base plate and motor mount such that motor shaft 106 is extendable through the same. The head unit is mounted at an upper end of motor shaft 106. The motor power unit is mounted at a lower end of motor shaft 106. As a result, rotation of the shaft and motor mount relative to the base plate also rotates the steering module 104 carried by the motor mount. The trim module 102, the motor shaft 106, the head unit, and the motor power unit tilt or translate with the steering module 104 given their direct or indirect connection thereto.

In the embodiment of FIGS. 1 and 2, the trim module 102 may omit the use of the aforementioned slip ring commonly-used on conventional trolling motors, and instead rely upon a direct wired connection of its control mechanism to a power source. In this context, the trim module control mechanism includes, but is not limited to, a drive motor and an internal control module of the trim module. In embodiments of the invention, the internal control module transmits wired or wireless signals that control the trim module drive motor. Particular embodiments allow for replacement of the slip rings with a coiled conductive cord 120, or cable, wound around the motor shaft 106 that rotates the trim module 102 such that the coiled conductive cable 120 facilitates rotation of the trim module 102 up to approximately 200 degrees in both clockwise and counterclockwise directions, an example of which is illustrated by arrow 116 in FIGS. 1 and 2.

Other embodiments allow for rotation of the trim module at least 200 degrees, or even more than 200 degrees, for example up to 360 degrees, while still other embodiments allow for less than 200-degree rotation. For example, in specific embodiments, the conductive cord coiled and trim module are configured such that the trim module can rotate at least 180 degrees from the unrotated state. In certain embodiments, the conductive cord coiled and trim module are configured such that the trim module can rotate at least 360 degrees in the clockwise or counterclockwise direction from the unrotated state.

The connections between the power supply and the trim module drive motor 108 and internal control module 114 is effected via the coiled conductive cable 120 which avoids any data drops due to interruptions in the wireless signal from the internal control module 114. In a further embodiment, the coiled conductive cord 120 transmits control signals from an internal control device, located for example in the steering module 104 or some other portion of the trolling motor, to the internal control module 114 in the trim module 102.

Thus, in embodiments of the invention, electrical power and/or control signals are relayed from one rotational system to another fixed (or rotational) system contained in a mechanically joined interface by means of the coiled conducting cord 120. More specifically, electrical power and/or control signals are relayed from an internal control device to the drive motor and internal control module in the trim module 102. Typically, the conductive cord 120 will be connected to an electrical device and a power source that are external to the trim and steering modules 102, 104. However, as referenced above, even with the external connection, the cable or cord 120 may be coiled around the motor shaft 106 in such a way as to permit rotation of the trim module 102, from a normal un-rotated state, about 200 degrees in either the clockwise or counterclockwise direction from an unrotated state, for example where the trolling motor propeller is facing sternward or in the direction directly behind the boat.

As stated above, it is envisioned that alternate embodiments will allow for rotation of the trim module 102 more than, or less than, 200 degrees. For example, in specific embodiments, the conductive cord coiled and trim module are configured such that the trim module can rotate at least 180 degrees from the unrotated state. However, embodiments of the invention include those where the coiled conductive cable 120 permits rotation of the trim module 102 from a normal un-rotated state to 360 degrees in the clockwise and counterclockwise directions.

Figure 3:
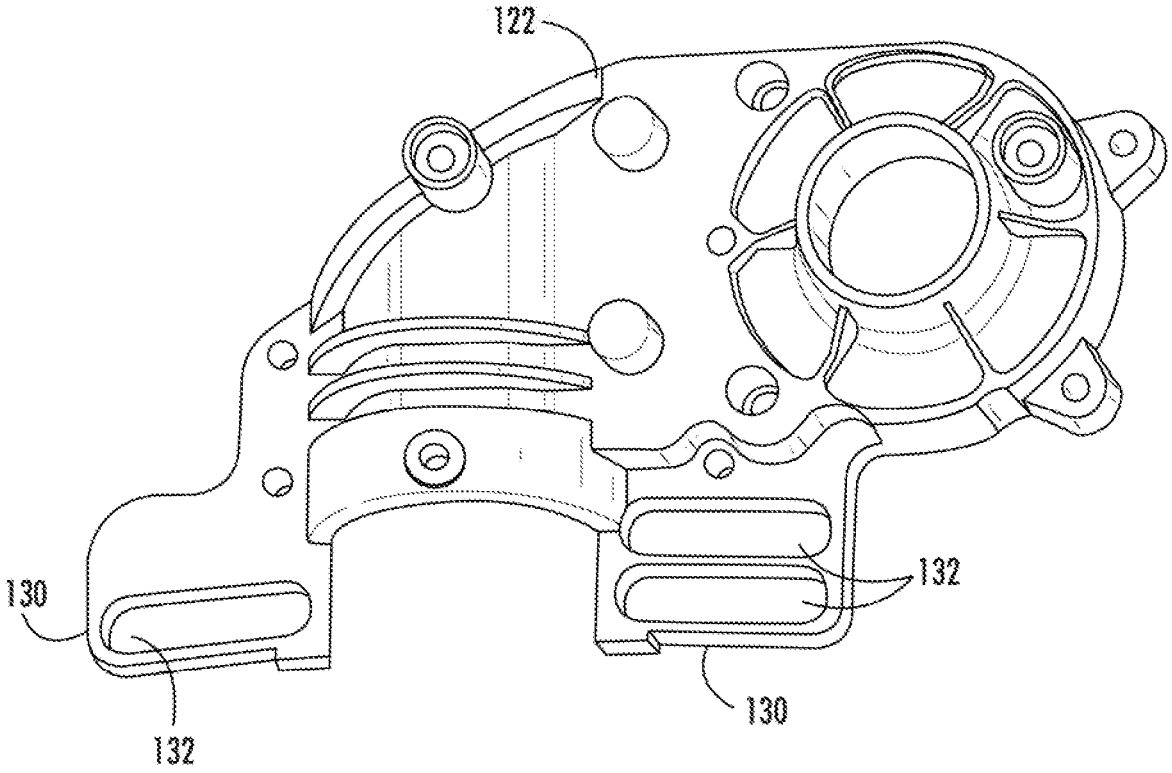
FIG. 3 is a perspective view of the trim module frame with guide fingers, according to an embodiment of the invention.

In one embodiment, a frame 122 in the trim module 120 includes guide fingers 130 that are used to keep the coiled cable 120 from tangling or binding. As shown in FIG. 3, the guide fingers 130 may be comprised of one or more slotted openings 132 in the frame 122 of the trim module 102. The guide fingers 130 used to guide and separate the individual coils of the coiled cable 120 so that they do not bind or collapse on themselves. Additionally, the guide fingers 130 in the frame guide the coiled cable 120 for expansion and contraction during rotation. As can be seen, the embodiment of FIGS. 1 and 2 do not include the optional guide fingers 130, however one of ordinary skill in the art would recognize that the frame embodiments shown in FIG. 3 could be advantageous if incorporated in the embodiment of FIGS. 1 and 2.

In the embodiment of FIG. 3, the frame 122 includes two sets of guide fingers 130 designed to on opposite sides (or about 180 degrees apart) of the motor shaft 106 when the frame 122 and trim module 102 are assembled to the motor shaft 106. In FIG. 3, one set of guide fingers 130 has two slotted openings 132, while the other set of guide fingers has one slotted opening 132. In the context of the present invention, it is understood that the term "set of guide fingers" includes those embodiments in which the set of guide fingers 130 has only one slotted opening 132. It should be recognized that embodiments of the invention may include frames 122 with more guide fingers 130 than shown in FIG. 3 or may have the same number of slotted openings 132 in each set of guide fingers 130, while alternate embodiments of the frame 122 may have only one set of guide fingers 130 with one or more slotted openings 132.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A trolling motor comprising:

a rotatable trim module which effectuates trim adjustment of the trolling motor by adjusting a vertical position of a motor shaft assembly;

a tiltable steering module mounted proximate the trim module, the steering module and trim module being assembled on a rotatable motor shaft having a motor mounted at one end of the motor shaft;

a conductive cord coiled around an outside of the motor shaft, the conductive cord configured to transmit electrical power from a power source to an internal control module and a drive motor in the trim module.

2. A trolling motor comprising:

a rotatable trim module which effectuates trim adjustment of the trolling motor by adjusting a vertical position of a motor shaft assembly;

a tiltable steering module mounted proximate the trim module, the steering module and trim module being assembled on a rotatable motor shaft having a motor mounted at one end of the motor shaft;

a conductive cord coiled around the motor shaft, the conductive cord configured to transmit electrical power from a power source to an internal control module and a drive motor in the trim module; and wherein the conductive cord is further configured to transmit control signals from an internal control device to the internal control module in the trim module.

3. The trolling motor of claim 2, wherein the internal control device is located in the steering module.

4. A trolling motor comprising:

a rotatable trim module which effectuates trim adjustment of the trolling motor by adjusting a vertical position of a motor shaft assembly;

a tiltable steering module mounted proximate the trim module, the steering module and trim module being assembled on a rotatable motor shaft having a motor mounted at one end of the motor shaft;

a conductive cord coiled around the motor shaft, the conductive cord configured to transmit electrical power from a power source to an internal control module and a drive motor in the trim module;

wherein the trim module includes a frame with guide fingers that are configured to keep the conductive cord from tangling or binding.

5. The trolling motor of claim 4, wherein the guide fingers are comprised of one or more slotted openings in a frame of the trim module.

6. The trolling motor of claim 4, wherein the trim module includes two sets of guide fingers spaced apart on the frame.

7. The trolling motor of claim 6, wherein a first set of guide fingers has one slotted opening, and a second set of guide fingers has two slotted openings.

8. The trolling motor of claim 6, wherein the two sets of guide fingers are located on opposite sides of a trolling motor shaft when the frame and the trim module are assembled to the trolling motor shaft.

9. The trolling motor of claim 2, wherein the conductive cord coiled and trim module are configured such that the trim module can rotate at least 200 degrees in the clockwise or counterclockwise direction from an unrotated state.

10. The trolling motor of claim 2, wherein the conductive cord coiled and trim module are configured such that the trim module can rotate at least 360 degrees in the clockwise or counterclockwise direction from an unrotated state.

11. The trolling motor of claim 2, wherein the conductive cord coiled and trim module are configured such that the trim module can rotate at least 180 degrees in the clockwise or counterclockwise direction from an unrotated state.

* * * * *